United States Patent [19]

Krijl et al.

[11] Patent Number: 4,497,877

[45] Date of Patent: Feb. 5, 1985

[54] METAL ARTICLE LAYERED WITH A NICKEL-PHOSPHORUS ALLOY AND A PROTECTIVE COATING

[75] Inventors: Gerrit Krijl; Renaat E. Van de Leest, both of Eindhoven, Netherlands

[73] Assignee: U.S. Philips Corporation, New York, N.Y.

[21] Appl. No.: 491,101

[22] Filed: May 3, 1983

[30] Foreign Application Priority Data

May 6, 1982 [NL] Netherlands ..... 8201849

[51] Int. Cl.[3] ..... C25D 3/04; B32B 9/00

[52] U.S. Cl. ..... 428/628; 428/469; 428/472; 428/457; 428/333; 428/629; 428/666; 428/679; 428/680; 428/926; 428/936; 126/901; 148/31.5

[58] Field of Search ..... 428/469, 472, 629, 633, 428/666, 679, 680, 935; 126/901; 148/31.5

[56] References Cited

U.S. PATENT DOCUMENTS 2,769,774 11/1956 Loveland, Jr. .
3,088,846 5/1963 Lee ..... 428/926
4,055,707 10/1977 McDonald ..... 428/679

FOREIGN PATENT DOCUMENTS 52-34436 3/1977 Japan ..... 126/901

OTHER PUBLICATIONS

Fan, J. C. C. et al., "Selective Black Absorbers Using Rf-Sputtered $Cr_2O_3$/Cr Cermet Films", *App. Physics Letters,* vol. 30, No. 10, pp. 511–513, (1977).

Wiederholt, *The Chemical Surface Treatment of Metal* Robert Draper Ltd., pp. 154, 155, 156, 158, 1965.

*Primary Examiner*—Veronica O'Keefe
*Attorney, Agent, or Firm*—Norman N. Spain

[57] ABSTRACT

A metal article which covered with a nickel-phosphorus alloy and which is covered on its outer surface with a protective layer which comprises $CrPO_4$, $Cr(OH)_3$ and may also comprise $Cr_2(SO_4)_3$ and in which no nickel is present. The layer provides an excellent corrosion protection. In a particular embodiment the layer is black, scratch-resistant in normal use, cannot be wiped off and is not sensitive to finger prints and is extremely suitable for decorative applications. The layers can be obtained electrolytically in a bath which comprises chromic acid and optionally reversed current in a given frequency range, a given range of current densities and a given range of ratios of cathodic to anodic pulse durations. In order to obtain the black layers the cathodic time duration is only a fraction of black layers the anodic time duration.

2 Claims, 1 Drawing Figure

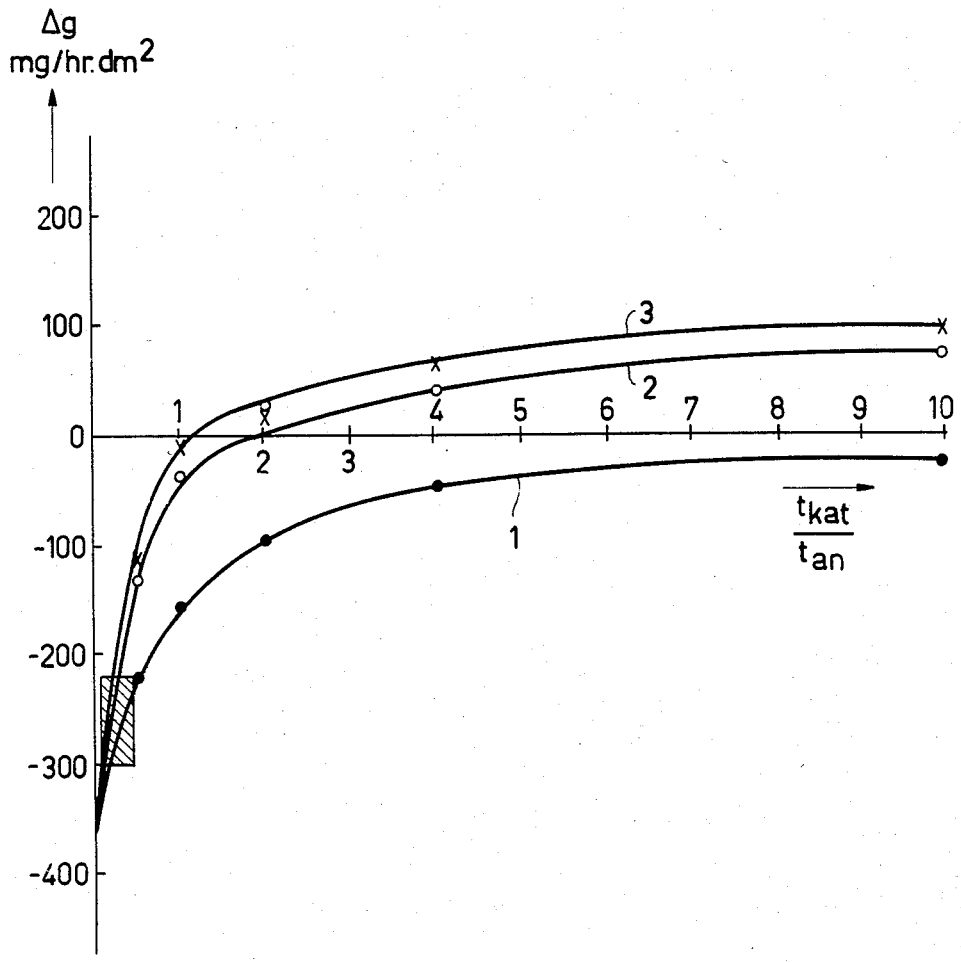
Δg
mg/hr.dm2
200
100
0
-100
-200
-300
-400
1
2
3
4
5
6
7
8
9
10
3
2
1
tkat
tan

METAL ARTICLE LAYERED WITH A NICKEL-PHOSPHORUS ALLOY AND A PROTECTIVE COATING

The invention relates to a metal article which is coated with a layer consisting of a nickel-phosphorus alloy, which layer is coated on its outer surface with a protective layer.

Such an article is disclosed in U.S. Pat. No. 3,088,846 the protective layer of which comprises nickel chromate or nickeloxyphosphate. In order to obtain said protective layer the article with the layer of the nickel-phosphorus alloy is immersed in an aqueous solution comprising chromate ions. The immersion preferably takes place at elevated temperature, for example, at 50° C. for 1 hour, and after the immersion a thermal treatment, for example 1 hour at 250° C., is necessary so as to obtain an optimum bonding of the resulting layer to the substrate.

As a result of this the treated articles have a life which, evaluated with reference to a standard salt spray test, is extended by more than 100% as compared with the untreated articles.

A disadvantage of the known treatment is that it has to be carried out at an elevated temperature for a rather long period of time and that a likewise rather long thermal after-treatment is necessary in order to obtain the optimum result.

It is the object of the invention to provide a metal article which has at least the same protection due to the presence of a protective layer and which is obtained by means of a method which is less time-consuming and requires less energy.

According to the invention, the protective layer consists of a conversion layer of a hydrated basic chromium phosphate which comprises the components $CrPO_4$ and $Cr(OH)_3$ in which $Cr(SO)_3$ may be present and in which the weight ratio Cr:P:S = 1:(0.2–1.5):(0–0.5).

The weight ratio of the said elements can easily be determined by means of modern physical analysis methods at surfaces, for example, that of Edax and Auger.

According to a special embodiment the layer has a black colour and hence is suitable for all kinds of decorative applications. In this form the layer consists of hydrated basic chromium phosphate with the components $CrPO_4$ and $Cr(OH)_3$, in which $Cr_2(SO_4)_3$ may be present and the weight ratio (Cr:P:S = 1:(0.2–1.5):(0–0.5).

The method of treating a metal article a surface layer of which consists of a nickel-phosphorus alloy, in a solution in water comprising chromate ions so as to obtain the protective layer according to the invention is characterized in that the treatment takes place in such a solution of chromic acid at ambient temperature and that the metal article to be treated is subjected as electrode to a periodically reversed current of frequency between 0.1 and 50 Hz with a current density between 0.2 and 1 A/dm$^2$ and a ratio of cathodic to anodic pulse durations between 0.05 and 20.

According to a preferred embodiment of the method according to the invention sulphuric acid and phosphoric acid are also present in the treatment liquid.

It is remarkable that no nickel is present in the layer.

SEM diagram and electro-chemical investigations have demonstrated that the layers may be considered as conversion layers and that they have the composition of x $CrPO_4.yCr(OH)_3.zCr_2(SO_4)_3.nH_2O$. Chromium sulphate may be absent but is preferably present in a considerable percentage. As indicated above the weight ratio Cr:P:S in the layer is 1:(0.2–1.5):(0–0.5).

It is assumed that Cr(III) hydroxide which is formed in the cathodic phase enters into a reaction with the phosphate ions, while $Ni^{2+}$-ions go into solution.

For a number of concentrations of the bath components it is stated in the Table below what percentage of the surface of a test plate in a Hull cell is covered with a layer. The test plates were subjected for 5 minutes to a periodically varying current of 0.5 A, a cathodic pulse of 2 seconds and an anodic pulse of 1 second. The test plate is placed in a Hull cell as electrode at an angle with respect to the counter electrode so that the electrode spacing and hence the current density varies.

TABLE

| Bath composition | % covered |
|---|---|
| 20 g/l $CrO_3$ | 65 |
| 20 g/l $CrO_3$ + 1.5 ml/l $H_2SO_4$ | 75 |
| 20 g/l $CrO_3$ + 5 ml/l $H_2SO_4$ | 53 |
| 20 g/l $CrO_3$ + 10 ml/l $H_2SO_4$ | 0 |
| 20 g/l $CrO_3$ + 1.5 ml/l $H_3PO_4$ | 67 |
| 20 g/l $CrO_3$ + 5 ml/l $H_3PO_4$ | 72 |
| 20 g/l $CrO_3$ + 10 ml/l $H_3PO_4$ | 80 |
| 20 g/l $CrO_3$ + 25 ml/l $H_3PO_4$ | 85 |
| 20 g/l $CrO_3$ + 50 ml/l $H_3PO_4$ | 81 |
| 20 g/l $CrO_3$ + 25 ml/l $H_3PO_4$ + 1.5 ml/l $H_2SO_4$ | 100 |
| 20 g/l $CrO_3$ + 20 ml/l $H_3PO_4$ + 5 ml/l $H_2SO_4$ | 78 |
| 20 g/l $CrO_3$ + 50 ml/l $H_3PO_4$ + 5 ml/l $H_2SO_4$ | 100 |
| 20 g/l $CrO_3$ + 50 ml/l $H_3PO_4$ + 20 ml/l $H_2SO_4$ | 0 |

As appears from this Table, the addition of a small quantity of sulphuric acid has a favourable influence on the action of the chromic acid. However, this effect appears to full advantage only when a considerable quantity of phosphoric acid is also present.

According to a further elaboration of the method in accordance with the invention, the above-described deep black coloured layers can be obtained in a small range of ratios of the cathodic to the anodic pulse and of the frequency, namely in the range $t_{cath}/t_{an}$ between 0.1 and 0.8 in the frequency range from 0.5 to 25 Hz.

Dependent upon time and current density when the method in accordance with the invention is used, products can be obtained having a great variation of colours varying from iridescent via uniformly yellow, blue or purple to deep black. In a very thick layer obtained, for example, by treating for 30 minutes with a current density of 0.5 A/dm$^2$, the natural colour, light green, of the layer becomes visible. Of course, this relates to the frequency and pulse ratio range beyond that in which the black layers are obtained.

The ratio of the cathodic pulse duration to the anodic one can be varied considerably in which the following ranges can be distinguished.

cathodic: no layer is formed $t_k/t_a$ 20–10: a light blue layer $t_k/t_a$ 10–0.5: an iridescent layer dependent on the current density $t_k/t_a$ 0.5–0.05: a dark layer anodic: a black layer than can be wiped off.

In the range where $t_k/t_a$ is approximately 0.5–0.05, the layer as a rule is iridescent but simultaneously a dark colour is visible which is characteristic of the anodic process.

The black colour will become more predominant especially when the layer gets the opportunity to grow for a longer period of time. After a treating time of approximately 30 minutes or longer the layer is completely black, scratch resistant in normal use, cannot be wiped off or is not sensitive to finger prints, and in this form is very attractive for decorative applications.

The FIGURE shows the weight variation of a plate treated according to the invention in accordance with the pulse duration and the frequency.

Steel plates which have been electrolessly nickel plated in a bath which is marketed by Messrs. Enthone under the name "Enplate 415" and which comprises a nickel salt, sodium hypophosphite and a complex former, were dried and weighed, then treated in a solution comprising per liter 10 g of $CrO_3$, 10 ml of concentrated phosphoric acid and 1 ml of concentrated sulphuric acid, dried and weighed again so as to determine the increase or decrease in weight. The variation in weight found is the net result of dissolving nickel-phosphorus and the formation of the layer. The largest decrease in weight proves to be the result of the anodic treatement: approximately 350 mg/hour $dm^2$.

The graph (FIGURE) shows the weight variation $\Delta g$ in mg/hour.$dm^2$ with an average current density of 0.5 A/$dm^2$ as a function of the ratio $t_k/t_a$ and this at the frequencies of 0.1, 1 and 10 Hz (curves 1.2 and 3, respectively). Cathodically no layer is formed at all.

In the shaded part of the diagram the black layer is formed, the remaining area indicates the conditions for the formation of coloured layers. In these cases iridescent layers are formed within a few minutes. After longer periods of time, approximately 30 minutes or longer, very dark iridescent layers are formed at 0.1 Hz, uniform yellowish green layers are formed at 1 Hz and yellowish green to purple coloured layers are formed at 10 Hz.

The presence of chromic acid in the solution to be used for the method in accordance with the invention is essential for the formation of the above described layers. When chromic acid is absent, the Ni-P is etched in which it obtains a black powdery appearance, both anodically and when periodically varying current is used. When the chromium content is 20 g/l or more, even at $t_k/t_a=0.3$ no black layer is formed but the layer is iridescent. Furthermore it is not possible to form a black layer without phosphoric acid. Without sulphuric acid no black layer is formed at low current densities.

Two specific embodiments will now be described by way of example.

EXAMPLE 1

A layer of phosphorus-containing nickel was deposited in a thickness of 2 $\mu$m on steel plates from the above-mentioned "Enplate 415" bath at 90° C.

The nickel-plates were then subjected to a periodically reversed current in an electrolyte solution of the composition per liter:

10 g of $CrO_3$
20 ml of concentrated $H_3PO_4$
2 ml of concentrated $H_2SO_4$ at a temperature of 20° C. together with a stainless steel counter electrode of approximately the same area. The current density (absolute value) was 0.5 A/$dm^2$ and the alternating frequency was 0.5 Hz, i.e. 1 second anodically and 1 second cathodically, the applied voltage having the block shape with equal values of the anodic and cathodic currents. After 1 minute an iridescent layer was obtained. A weight ratio Cr:P:S of 1:0.47:0.05 was determined in the layer. With an electrolytic treatment duration of 30 minutes a uniform olive-green layer was obtained.

The corrosion resistance of the plates, which had been submitted to a 4 minutes treatment was tested by means of a salt spray test (ASTM Designation B 117-64) by nebulizing a 5% solution of NaCl in water at room temperature on the surface. Untreated plates showed considerable rust formation after 48 hours. Substantially no rust was formed on the plates treated in accordance with the invention after 48 hours.

EXAMPLE 2

Electrolessly nickel-plated steel plates with a layer thickness of Ni of 5 $\mu$m were subjected in the electrolyte liquid of Example 1 to a periodically reversed current with a current density of 0.5 A/$dm^2$, an alternating frequency of 2 Hz but this time with a cathodic pulse duration of 0.1 second and an anodic pulse duration of 0.4 second ($t_k/t_a=0.25$). After 30 minutes a deep black coloured layer was obtained. A weight ratio Cr:P:S of 1:1:0.04 was determined in said layer.

What is claimed is:

1. A metal article which is coated with a layer consisting of a nickel-phosphorus alloy, which layer is coated on its outer surface by a protective layer, characterized in that the protective layer consists of a nickel-free conversion layer of a hydrated basic chromium phosphate which comprises the components $CrPO_4$ and $Cr(OH_3)$, wherein $Cr_2(SO_4)$, may be present and in which the weight ratio Cr:P:S=1:(0.2–1.5):(0–0.5).

2. A metal article as claimed in claim 1, characterized in that the protective layer has black colour and consists of a hydrated chromium phosphate of the components $CrPO_4$ and $Cr(OH)_3$ wherein $Cr_2(SO_4)_3$ may be present and in which the weight ratio Cr:P:S=1:1:(0–1.2).

* * * * *

UNITED STATES PATENT AND TRADEMARK OFFICE

CERTIFICATE OF CORRECTION

PATENT NO. : 4,497,877

DATED : February 5, 1985

INVENTOR(S) : GERRIT Krijl, et al.

It is certified that error appears in the above—identified patent and that said Letters Patent is hereby corrected as shown below:

In the title Page, in the Abstract:

Column 2, line 1, after "which" insert --is--;

In the Claims:

Column 4, line 50, change "(0-1.2)" to --(0-0.2)--.

Signed and Sealed this

*Twentieth* Day of *August 1985*

[SEAL]

*Attest:*

DONALD J. QUIGG

*Attesting Officer* *Acting Commissioner of Patents and Trademarks*